US011021927B2

(12) United States Patent
Hiorth

(10) Patent No.: US 11,021,927 B2
(45) Date of Patent: Jun. 1, 2021

(54) WELL TOOL ASSEMBLY

(71) Applicant: Interwell Norway AS, Hafrsfjord (NO)

(72) Inventor: Espen Hiorth, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 16/628,437

(22) PCT Filed: May 28, 2018

(86) PCT No.: PCT/EP2018/063885
§ 371 (c)(1),
(2) Date: Jan. 3, 2020

(87) PCT Pub. No.: WO2019/007589
PCT Pub. Date: Jan. 10, 2019

(65) Prior Publication Data

US 2020/0165895 A1 May 28, 2020

(30) Foreign Application Priority Data

Jul. 5, 2017 (NO) ..... 20171109

(51) Int. Cl.
*E21B 33/128* (2006.01)
*E21B 47/117* (2012.01)
(Continued)

(52) U.S. Cl.
CPC ..... *E21B 33/1285* (2013.01); *E21B 17/1014* (2013.01); *E21B 33/1293* (2013.01);
(Continued)

(58) Field of Classification Search
CPC ..... E21B 33/1285; E21B 33/1293; E21B 33/1295; E21B 17/1014; E21B 47/117; E21B 47/06
(Continued)

(56) References Cited

U.S. PATENT DOCUMENTS 3,015,362 A 1/1962 Moosman
3,876,003 A 4/1975 Kisling, III
(Continued)

FOREIGN PATENT DOCUMENTS

GB 2489984 A 10/2012
WO 2012/079914 A2 6/2012
(Continued)

OTHER PUBLICATIONS

International Search Report issued in Application No. PCT/EP2018/063885, dated Aug. 16, 2018 (6 pages).
(Continued)

*Primary Examiner* — Taras P Bemko
(74) *Attorney, Agent, or Firm* — Osha Bergman Watanabe & Burton LLP

(57) ABSTRACT

The invention relates to a well tool assembly (1) comprising a setting tool (10) and a plugging tool (20). The plugging tool (20) comprises:

an inner mandrel device (21) and an outer housing device (26), an upper sealing device (30), a slips device (40), a lower sealing device (50) and a centralizing device (60) connected to each other in an axial direction outside of the mandrel device 21. The slips device (40) is provided axially between the upper and lower sealing devices (30, 50). The centralizing device (60) is provided below the lower sealing device (50) or above the upper sealing device (30). When the centralizing device (60) is provided below the lower sealing device (50), the upper sealing device (30), the slips device (40), the lower sealing device (50) and the upper section (61) of the centralizing device (60) are axially displaceable downwardly and upwardly in relation to the mandrel device (21) and the upper section (31) of the upper sealing device (30) is connected to the outer housing
(Continued)

device (26) and the lower section (62) of the centralizing device (60) is fixed to the inner mandrel device (21). When the centralizing device (60) is provided above the upper sealing device (30), the centralizing device (60), the upper sealing device (30), the slips device (40) and the upper section (51) of the lower sealing device (50) are axially displaceable downwardly and upwardly in relation to the mandrel device (21) and the upper section (61) of the centralizing device (60) is connected to the outer housing device (26) and the lower section (52) of the lower sealing device (50) is fixed to the inner mandrel device (21).

8 Claims, 5 Drawing Sheets

(51) Int. Cl.
*E21B 17/10* (2006.01)
*E21B 33/129* (2006.01)
*E21B 33/1295* (2006.01)
*E21B 47/06* (2012.01)

(52) U.S. Cl.
CPC ..... *E21B 33/1295* (2013.01); *E21B 47/117* (2020.05); *E21B 47/06* (2013.01)

(58) Field of Classification Search
USPC ..... 166/250.17
See application file for complete search history.

(56) References Cited

U.S. PATENT DOCUMENTS

| | | | | |
|---|---|---|---|---|
| 4,706,746 | A | 11/1987 | White et al. | |
| 2010/0078173 | A1 | 4/2010 | Buytaert et al. | |
| 2013/0277053 | A1* | 10/2013 | Yeh | E21B 34/14 166/278 |
| 2013/0319654 | A1* | 12/2013 | Hiorth | E21B 33/128 166/179 |
| 2014/0196913 | A1* | 7/2014 | Pedersen | E21B 33/1293 166/386 |
| 2017/0234102 | A1* | 8/2017 | Svartvatn | E21B 33/128 166/382 |

FOREIGN PATENT DOCUMENTS

| | | | |
|---|---|---|---|
| WO | 2012/082305 | A2 | 6/2012 |
| WO | 2016/028155 | A1 | 2/2016 |

OTHER PUBLICATIONS

Written Opinion issued in International Application No. PCT/EP2018/063885, dated Aug. 16, 2018 (9 pages).
Search Report issued in Norwegian Application No. 20171109, dated Jan. 22, 2018 (2 pages).

* cited by examiner

WELL TOOL ASSEMBLY

FIELD OF THE INVENTION

The present invention relates to a well tool assembly comprising a setting tool and a plugging tool. The well tool assembly is used for pressure testing of a well. The present invention also relates to a method for pressure testing a well. In particular, the well tool assembly and method is used for pressure testing of different zones in the well.

BACKGROUND OF THE INVENTION

During operations in hydrocarbon producing wells, there is a need to test different zones in the well. In one situation, one zone in the well may be producing water instead of oil/gas. It is then necessary to determine the location of that water-producing zone and thereafter to isolate that water-producing zone of the well. The operation of determining the location of such a zone is often time-consuming. One common way of doing this is to lower and set a plugging tool at an initial location in the well. The setting tool is then retrieved to surface, whereafter the content of the well fluid from the formation above the plug is analyzed to check if the initial location was the correct location. If not, the plugging tool is released by a releasing tool, retrieved to surface and a new plug is run to a new location before setting of the plugging tool again. Some plugging tools requires the releasing tool and the plugging tool to be retrieved to surface and reconfigured before a setting tool is used to set the plugging device again.

Another operation performed in such wells is a pressure test of the tubing itself, to check for leakages in the tubing pipe joints. Another type of pressure test is the pressure test of the gas lift valves.

Such plugging tools are typically using a ratchet mechanism to lock the plugging tool in its set (radially expanded) state, even if the setting tool is still connected to the plugging tool. This is necessary, as setting tools has a limited setting force. As an example, some setting tools have a setting force of 15 tons. However, when set, the differential pressure over a sealing element of such a plugging tool may be as high as 70 000 lbf (corresponding to a weight of 31 tons), which will press the setting tool upwardly and destroy the setting tool. The disadvantage with the ratchet mechanism is that, when set, it is cumbersome to reset again, as this typically requires a disassembly of the tool. Hence, it is often the resetting of the ratchet mechanism which is causing the number of runs needed during the abovementioned operations.

Hence, it is an object of the invention to provide a simple and efficient well tool assembly for testing zones in a well. A further object is to provide a well tool assembly which may be run by means of wireline, e-line or similar, i.e. without drill pipe or without coiled tubing. Yet a further object is to provide a well tool assembly where the setting tool is capable of bringing the plugging tool between its run state and its set state a number of times, while the setting tool and plugging tool are connected to each other. Of course, it is an object that the plugging tool should be able to withstand a high pressure without any risk of destroying the setting tool. Yet a further object is to provide a well tool assembly without a ratchet mechanism. Another purpose of the present invention is to provide a method for pressure testing of a well which is efficient and fast.

SUMMARY OF THE INVENTION

The present invention relates to a well tool assembly comprising a setting tool and a plugging tool, where the setting tool comprises:

- an inner actuator having a inner connection interface in its lower end;
- an outer actuator having a outer connection interface in its lower end, where the setting tool is configured to provide relative axial motion between the inner and outer actuators, thereby causing the plugging tool to be moved between its radially retracted state and its radially expanded state;

where the plugging tool comprises:

- an inner mandrel device having a inner connection interface connected to the inner connection interface of the setting tool;
- an outer housing device provided radially outside of the mandrel device having a outer connection interface connected to the outer connection interface of the setting tool;
- an upper sealing device comprising an upper sealing element provided axially between an upper section and a lower section;
- a slips device comprising a slips element provided axially between an upper section and a lower section;
- a lower sealing device comprising a sealing element provided axially between an upper section and a lower section;
- a centralizing device comprising a centralizer element provided axially between an upper section and a lower section;

where the devices are provided radially outside of the mandrel device;

where the devices are connected to each other;

where the slips device is provided axially between the upper and lower sealing devices;

where the centralizing device is provided below the lower sealing device or above the upper sealing device;

where, when the centralizing device is provided below the lower sealing device:

- the upper sealing device, the slips device, the lower sealing device and the upper section of the centralizing device are axially displaceable downwardly and upwardly in relation to the mandrel device;
- the upper section of the upper sealing device is connected to the outer housing device and the lower section of the centralizing device is fixed to the inner mandrel device;

or where, when the centralizing device is provided above the upper sealing device:

- the centralizing device, the upper sealing device, the slips device and the upper section of the lower sealing device are axially displaceable downwardly and upwardly in relation to the mandrel device;
- the upper section of the centralizing device is connected to the outer housing device and the lower section of the lower sealing device is fixed to the inner mandrel device.

Accordingly, there are two different options with respect to where the centralizing device is located.

In one aspect, the assembly is a pressure testing well tool assembly for pressure testing of a section of a well. However, the assembly can be used for other purposes as well.

The plugging tool is a ratchet-less plugging tool, as all parts of the devices are axially displaceable downwardly and upwardly in relation to the mandrel device, with the exception of the lower section of the lowermost device, which are fixed to the inner mandrel device.

In one aspect, the lower section of the lowermost device is comprising a nose section of the plugging tool, where the lose section is providing a closing of a bore through the inner mandrel device. In an alternative embodiment, the bore is a through bore. Also here, a nose section can be provided to ease the lowering of the plugging tool into the well, where the bore through the mandrel device is continued through the nose section.

In one aspect the upper sealing device and the lower sealing device each comprises a pressure or force distribution device.

In one aspect, when the plugging tool is in the radially expanded state in a well pipe, and the well pressure is higher below the lower sealing device than above the upper sealing device, the fluid pressure acting on the lower sealing device will cause the slips device to radially expand the slips element radially out towards the well pipe.

In one aspect, when the plugging tool is in the radially expanded state in a well pipe, and the well pressure is higher above the upper sealing device than below the lower sealing device, the fluid pressure acting on the upper sealing device will cause the slips device to radially expand the slips element radially out towards the well pipe.

In one aspect, the outer housing and the devices are connected to each other by means of bolts inserted into tangential bolt openings of the respective upper and lower sections.

The present invention also relates to a method for pressure testing of a section of a well, the method comprising the steps of:

a) lowering a well tool assembly comprising a setting tool and a plugging tool to a desired location in the well, the plugging tool comprising inner mandrel device, a outer housing device, a upper sealing device, a slips device, a lower sealing device and a centralizing device;

b) bringing, by means of the setting tool, the upper sealing device, the slips device, the lower sealing device and the centralizing device from their radially retracted state to their radially expanded state;

c) performing the pressure testing by increasing the pressure below and/or above the plugging tool;

d) bringing, by means of the setting tool, the upper sealing device, the slips device, the lower sealing device and the centralizing device from their radially expanded state to their radially retracted state;

e) moving the well tool assembly to a new desired location in the well;

f) repeating steps b-d.

Preferably, the setting tool is connected to the plugging tool during all steps a-f.

DETAILED DESCRIPTION

Embodiments of the invention will be described in detail below with reference to the enclosed drawings, where:

The terms "upper", "above", "below" and "lower" is used in the document to define positions in a well. "Upper" and "above" in the context of this document mean closer to the well opening and "lower" further away from the well opening. These terms apply both when the well has a vertical and horizontal orientation.

A "ratchet mechanism" is a well known mechanism for tools used in oil and/or gas wells. The ratchet mechanism may have many different designs, but the main principle is that relative axial movement between an inner pipe with respect to an outer pipe is allowed in one direction only, while relative axial movement in the opposite direction is prevented. One example of such a "ratchet mechanism" is known from WO 2016087641 in the name of Interwell.

Figure 1:
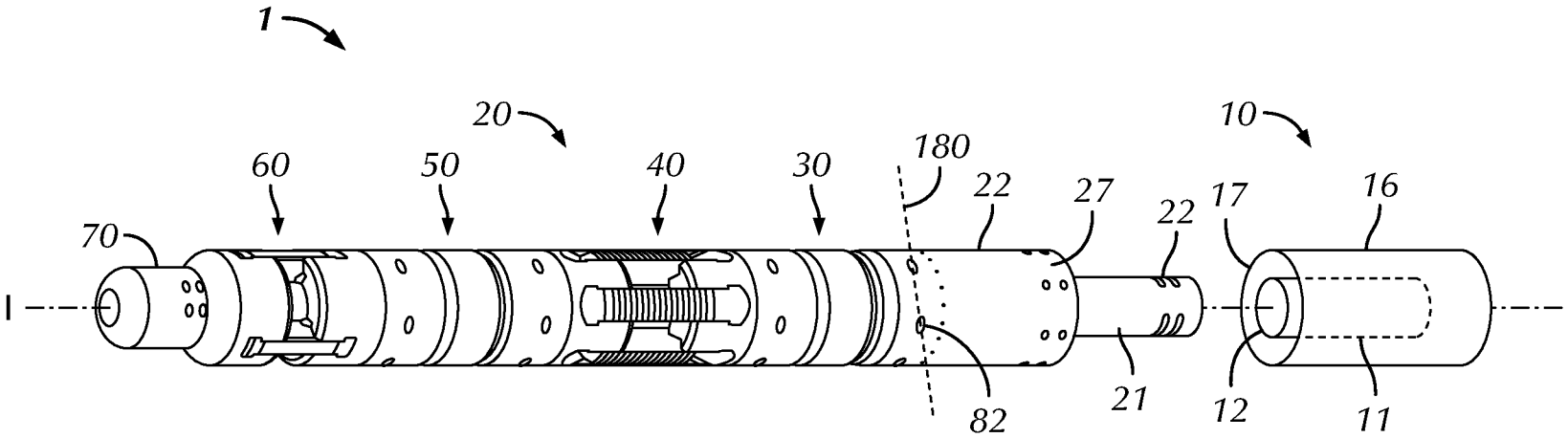
FIG. 1 illustrates a perspective view of the well tool assembly in a run state, where the setting tool is illustrated schematically.
Figure 2:
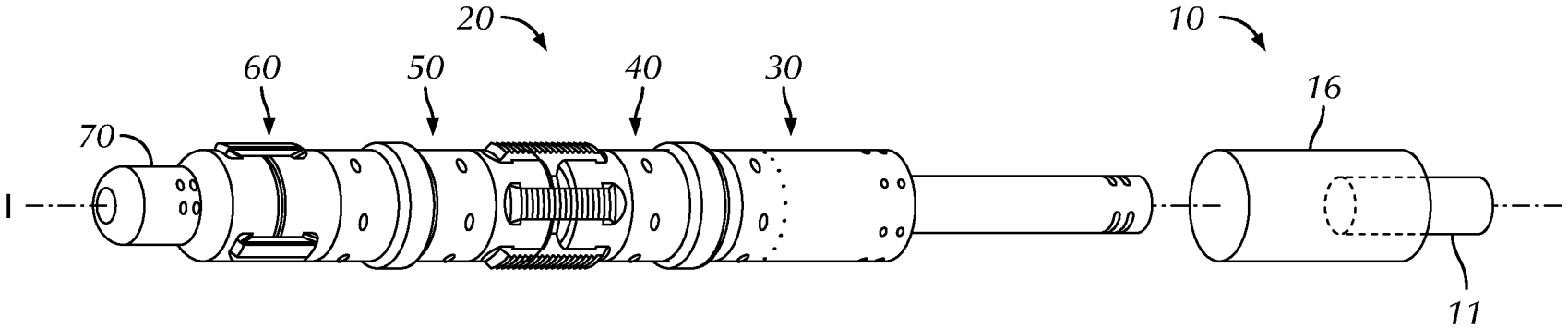
FIG. 2 illustrates a perspective view of the well tool assembly in the set state.

It is now referred to FIGS. 1 and 2. Here, a well tool assembly 1 is shown comprising a setting tool 10 and a plugging tool 20.

The setting tool 10 is shown schematically comprising an inner actuator 11 (drawn as an inner cylinder) and an outer actuator 16 (drawn as an outer cylinder) provided radially outside of the inner actuator 11. The inner actuator 11 has an inner connection interface 12 in its lower end and the outer actuator 16 has an outer connection interface 17 in its lower end. The setting tool 10 is configured to provide relative axial motion between the inner and outer actuators 11, 16.

This relative axial motion may for example be provided by an electric actuator, for example an electric motor powered by a battery. In such an embodiment, the setting tool may be lowered into the well by means of a wireline. Alternatively, the setting tool may be lowered into the well by means of an e-line for transferring signals (and possibly also electric power, replacing the need for a battery) between the setting tool and topside.

In yet an alternative embodiment, the relative axial motion is provided by an hydraulic actuator, for example a hydraulic pump connected to an electric motor powered by a battery.

The setting tool 10 is considered known for a skilled person and will not be described further in detail herein. However, it should be noted that the setting tool 10 is configured to provide relative axial motion between the inner and outer actuators 11, 16 a number of times, without the need of retrieving the setting tool to surface. The setting tool 10, as such, is known within the art and will not be described in any further detail here. However, a setting tool 10 suitable for use in the assembly of the present invention may for example be of the type presently used in the EST tool (Electronic Setting Tool) marketed by Interwell.

The purpose of the relative axial motion between the inner and outer actuators 11, 16 is to move the plugging tool 20 between its radially retracted state (shown in FIG. 1) and its radially expanded state (shown in FIG. 2). The radially retracted state is often referred to as the "run" state, as the plugging tool 20 is in this state when run into or lowered into the well. The radially expanded state is often referred to as the "set" state, as the plugging tool 20 is in this state when set in the well (i.e. the plugging tool 20 is engaged with the inner surface of the well).

The plugging tool 20 comprises an inner mandrel device 21 and an outer housing device 26 provided radially outside of the inner mandrel device 21. The inner mandrel device 21 has an inner connection interface 22 connected to the inner connection interface 12 of the setting tool 20 The outer housing device 26 has a outer connection interface 27 connected to the outer connection interface 17 of the setting tool 20. The mandrel device 21 further comprises a bore B.

It should be noted that in FIGS. 1 and 2, the plugging tool 20 and the setting tool 10 are separated from each other. However, as is known for a skilled person, the setting tool 10 and the plugging tool 20 must be connected to each other in order to bring the plugging tool 20 between its radially retracted state and its radially expanded state.

The plugging tool 20 further comprises an upper sealing device 30, a slips device 40, a lower sealing device 50 and a centralizing device 60. Each of the devices 30, 40, 50 and 60 can be brought between their radially retracted states of FIG. 1 and their radially expanded states of FIG. 2. Each of these devices 30, 40, 50 and 60 are also provided radially outside of the mandrel device 21.

Figure 3:
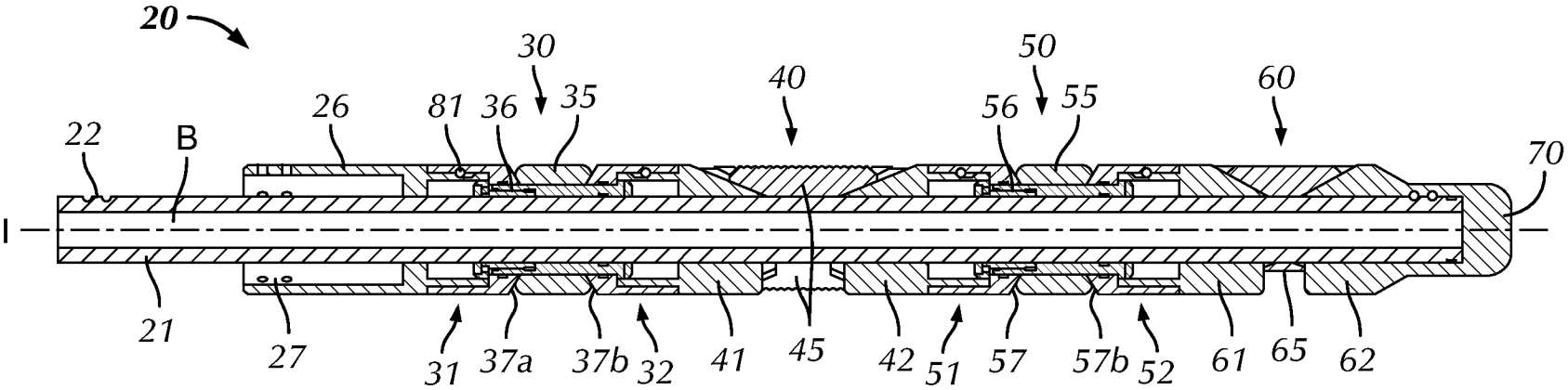
FIG. 3 illustrates a cross sectional view of the plugging tool in its run state.
Figure 4:
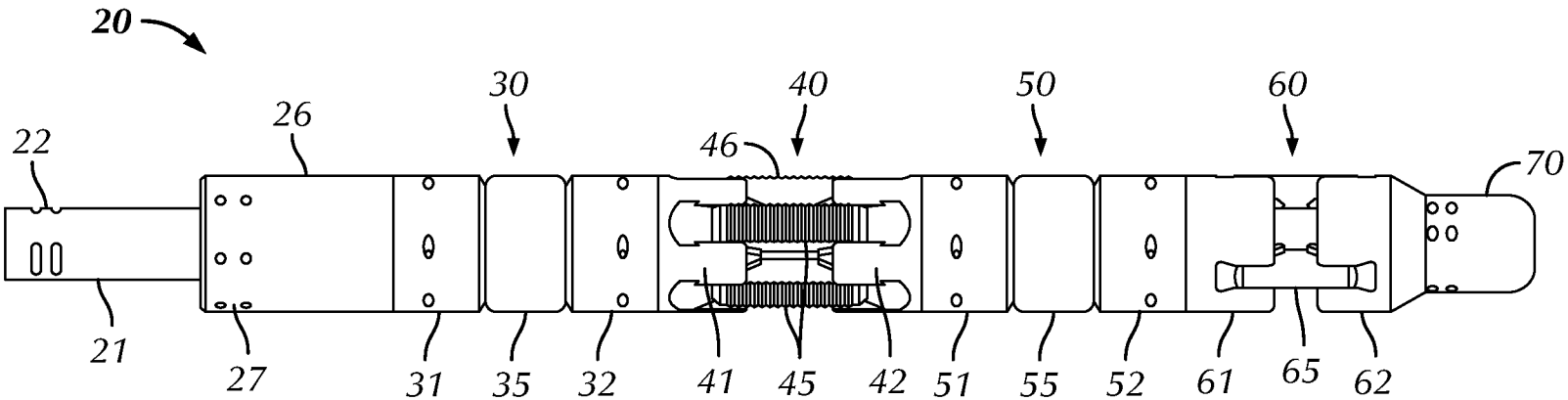
FIG. 4 illustrates a side view of the plugging tool in its run state.
Figure 5:
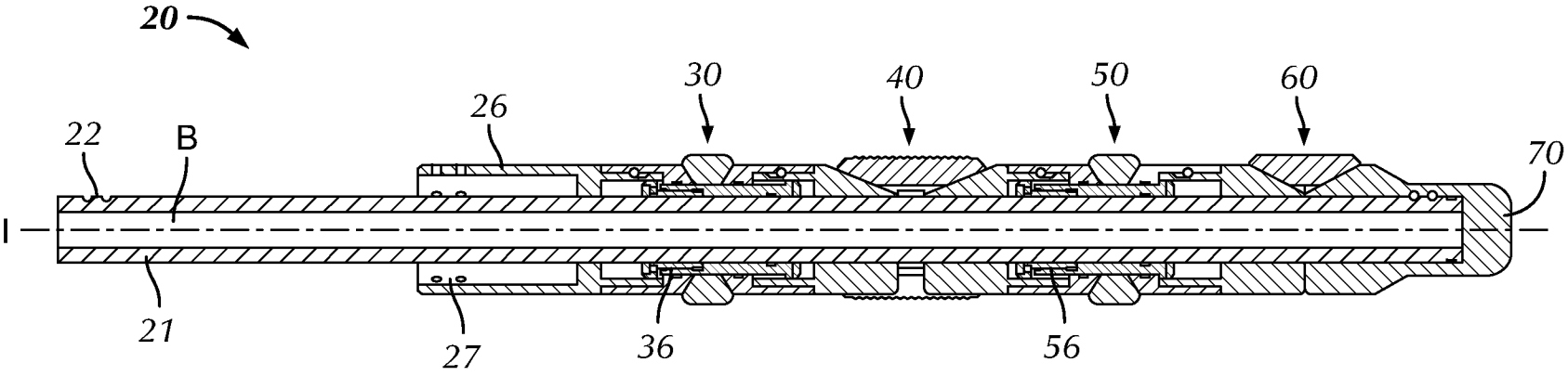
FIG. 5 illustrates a cross sectional view of the plugging tool in its set state.
Figure 6:
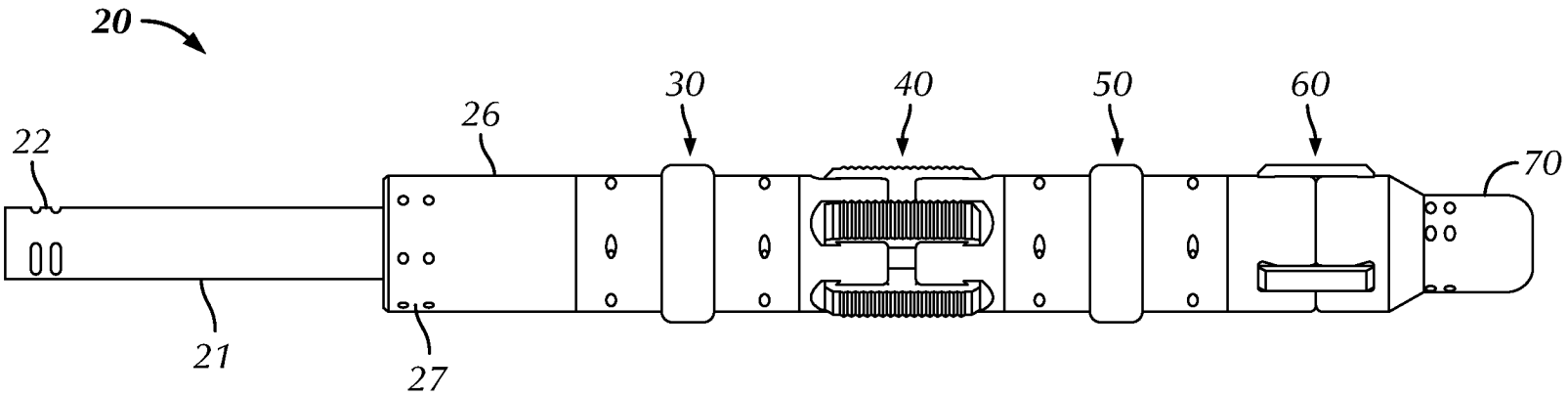
FIG. 6 illustrates a side view of the plugging tool in its set state.

It is now referred to FIGS. 3 and 4 (retracted state) and FIGS. 5 and 6 (expanded state).

The upper sealing device 30 comprises an upper section 31 connected to the outer housing device 26 and a lower section 32. The upper section 31 comprises a first supporting element 37*a* and the lower section 32 comprises a second supporting element 37*b*. An upper sealing element 35 is connected between the upper and lower sections 31, 32 of the upper sealing device 30 and circumferentially around and outside of the inner mandrel device 21, between the first and second supporting elements 37*a*, 37*b*. As is known, such sealing elements 35 may be made of a rubber or elastomeric or other suitable material. Axial movement of the upper and lower sections 31, 32 towards each other will cause a radial expansion of the sealing element 35, where the supporting elements 37*a*, 37*b* are supporting the sealing element 35 in the radially expanded state. In the radially expanded state, the sealing element 35 is pressed towards the well pipe to prevent axial fluid flow in the annular compartment between the plugging tool 20 and the well pipe, more specifically in the annular compartment between the mandrel device 21 of the plugging tool 20 and the well pipe. Axial movement of the upper and lower sections 31, 32 away from each other will cause a radial retraction of the sealing element 35.

The slips device 40 comprises an upper section 41 connected to the lower section 32 of the upper sealing device 30 and a lower section 42. A slips element 45 is connected between the upper and lower sections 41, 42 of the slips device 40. In the present embodiment, the slips device 40 comprises three, five or seven slips elements 45. In the radially expanded state, the slips elements 45 are pressed towards the well pipe to prevent axial movement of the plugging tool 20 in relation to the well pipe. Each slips element 45 comprises a teethed outer surface 46 to improve its engagement with the inner surface of the well pipe. The slips device 40 also contributes to centralize the plugging tool 20 with respect to the well pipe, i.e. to provide that the longitudinal center axis I of the plugging tool 20 substantially coincides with the longitudinal center axis Iw (shown in FIGS. 7 and 8) of the well pipe.

The slips element 45 is connected to the upper section 41 and the lower section 42 by means of slits provided in wedge-shaped surfaces, pivotably connections etc. Hence, relative axial movement of the upper section 41 and the lower section 42 towards each other is causing the slips element 45 to radially expand in relation to the inner mandrel device 21. Relative axial movement of the upper section 41 and the lower section 42 away from each other is causing the slips element 45 to radially retract.

The lower sealing device 50 is similar to the upper sealing device 30 and comprises an upper section 51 connected to the lower section 42 of the slips device 40 and a lower section 52. The upper section 51 comprises a first supporting element 57*a* and the lower section 52 comprises a second supporting element 57*b* with similar purpose as the supporting elements 37*a*, 37*b* described above. A lower sealing element 55 is connected between the upper and lower sections 51, 52 of the slips device 40. In the radially expanded state, the sealing element 55 is pressed towards the well pipe to prevent axial fluid flow in the annular compartment between the plugging tool 20 and the well pipe.

The centralizing device 60 comprises an upper section 61 connected to the lower section 52 of the lower sealing device 50 and a lower section 62. A centralizer element 65 is connected between the upper and lower sections 61, 62 of the centralizing device 60. In the present embodiment, the centralizing device 50 comprises three centralizer elements 55. In the radially expanded state, the centralizer element 65 is pressed towards the well pipe to centralize the plugging tool 20 together with the slips device 40.

The upper and lower sealing devices 30, 50 is considered known in the art and will not be described in any further detail here. However, a sealing device suitable for use in the plugging tool of the present invention may for example be of the type presently used in the Matrix platform plug marketed by Interwell.

The slips device 40 is considered known in the art and will not be described in any further detail here. However, a slips device suitable for use in the plugging tool of the present invention may for example be of the type presently used in the Matrix platform plug marketed by Interwell.

The centralizing device 60 is substantially equal to the slips device 40, where the main difference is that the centralizer elements 65 have a smooth surface facing towards the inner surface of the well pipe. Another difference is that the number of centralizer elements 65 is lower (in this embodiment three) than the number of slips elements 45 (in this embodiment five).

The upper sealing device 30, the slips device 40, the lower sealing device 50 and the upper section 61 of the centralizing device 60 are axially displaceable downwardly and upwardly in relation to the mandrel device 21. According to this feature, it is apparent that the plugging tool 20 does not comprise a ratchet mechanism, as the ratchet mechanism described above only allows relative axial displacement in one direction (either upwardly or downwardly). Hence, the plugging tool 20 is ratchet-less. It should be noted that the setting tool 10 of the assembly 1 is ratchet-less as well.

In this embodiment, the centralizing device 60 is the lowest one of the devices 30, 40, 50, 60. Here, the lower section 62 of the centralizing device 60 is fixed to the mandrel device 21. By fixing the lower section 63 to the inner mandrel device 21, the axial displacement of the devices 30, 40, 50, 60 in relation to the mandrel device 21 is limited.

Accordingly, the setting tool 10 can bring the plugging tool 20 from its radially retracted state to its radially expanded state and back to the radially retracted state a number of times without the need for bringing the assembly 1 to surface. Each time the plugging tool 20 is in the radially expanded state, the plugging tool is able to withstand high relative pressures over the plugging tool, in both directions. This is possible due to the fact that the slips device 40 is located between the upper and lower sealing devices 30, 50 and that the load is transferred from the sealing devices 30, 50 to the slips device.

Hence, when the plugging tool 20 is in the radially expanded state in the well pipe and the well pressure is higher below the lower sealing device 50 than above the upper sealing device 30, the fluid pressure acting on the lower sealing device 50 will press the slips element 45 of the slips device 40 radially out towards the well pipe and hence prevent the plugging tool 20 to move in relation to the well pipe.

In the same way, when the plugging tool 20 is in the radially expanded state in the well pipe and the well pressure is higher above the upper sealing device 30 than below the lower sealing device 50, the fluid pressure acting on the upper sealing device 30 press the slips element 45 of the slips device 40 radially out towards the well pipe and hence prevent the plugging tool 20 to move in relation to the well pipe.

In an alternative embodiment, the centralizing device 60 could be provided above the upper sealing device 30. In such an embodiment, also the lower section 62 of the centralizing device 60 will be axially displaceable downwardly and upwardly in relation to the inner mandrel device 21, i.e. the entire centralizing device 60 is axially displaceable downwardly and upwardly in relation to the inner mandrel device 21. In such an embodiment, the lower sealing device 50 will be the lowest one of the devices 30, 40, 50, 60, and the lower centralizing element 62 will be fixed to the mandrel device 21. Hence, the also here, the axial displacement of the devices 30, 40, 50, 60 in relation to the mandrel device 21 is limited. And again, also here, the slips device 40 is located between the upper and lower sealing devices 30, 50.

As shown in FIGS. 3 and 4, the lower section 62 of the centralizing device 60 is comprising a nose section 70 of the plugging tool 20, where the lose section 70 is closing the bore B of the inner mandrel device 21.

It is now referred to FIGS. 3 and 5. Here, it is shown that the upper sealing device 30 and the lower sealing device 50 each comprises a pressure or force distribution device 36, 56. The pressure or force distribution device 36, 56 is known for a skilled person, for example from NO 339646 (also in the name of Interwell). NO 339646 is hereby incorporated by reference. The purpose of the force or pressure distribution devices 36, 56 is to avoid that the radial expansion (caused by axial compression) of the sealing elements 35, 55 by means of the supporting elements 37*a*, 37*b*, 57*a*, 57*b* is reduced due to pressure variations and/or temperature variations etc.

In the present embodiment, the devices 30, 40, 50, 60 are connected to each other by means of bolts 81 provided in tangential bolt openings 82 as indicated in FIGS. 1 and 3. In FIG. 1, a tangential line l80 is shown, indicating the direction of one of the tangential bolt openings 82. Such bolt connections are known for the skilled person, for example from NO 340229 (also in the name of Interwell).

Figure 7:
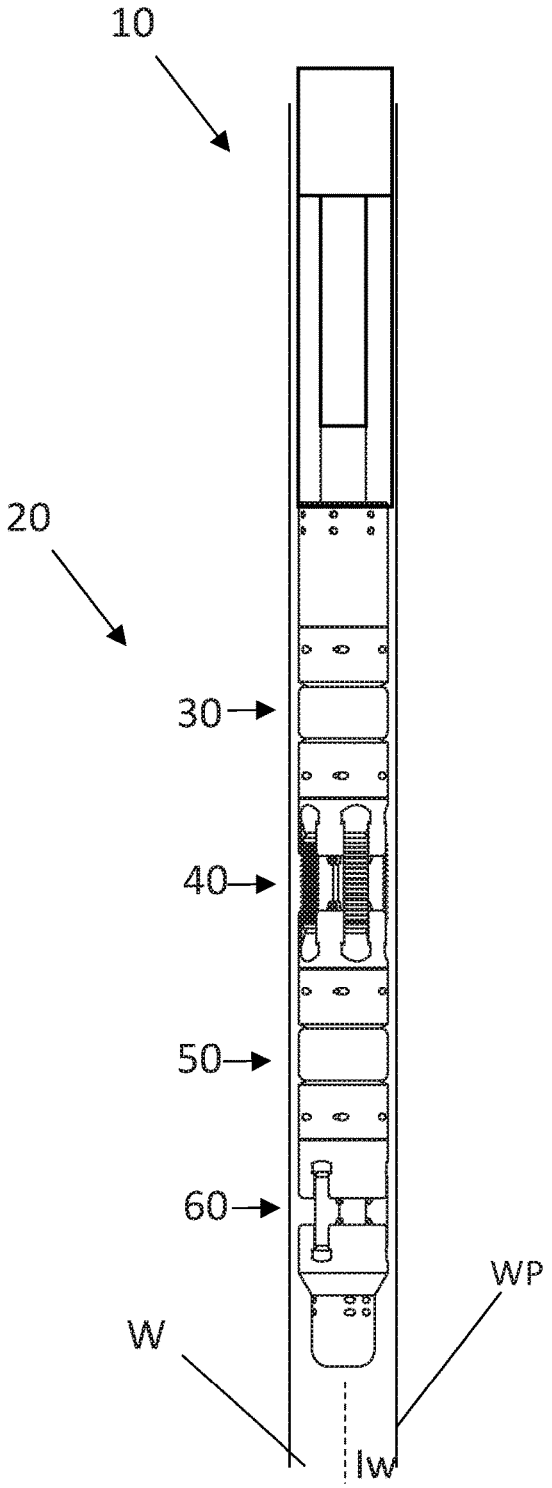
FIGS. 7 and 8 illustrates the well tool assembly in a well pipe in its run and set states respectively.
Figure 8:
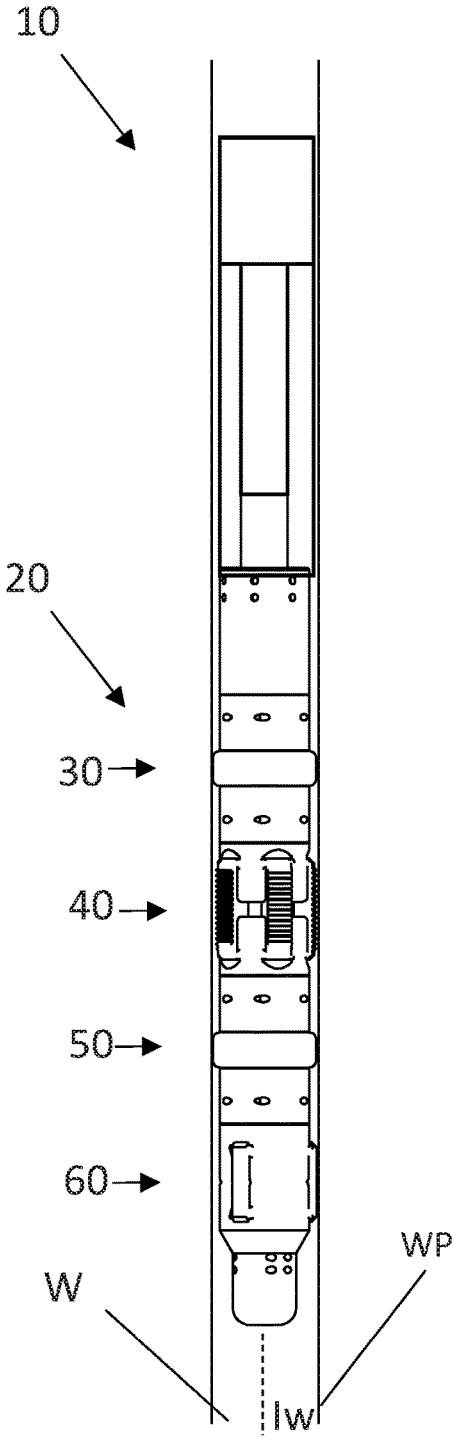

It is now referred to FIGS. 7 and 8, where the well tool assembly 1 described above is used as a pressure testing well tool assembly for pressure testing of a section of a well. A "section of a well" is here referring to a section of a well above the upper sealing device 30 or below the lower sealing device 50. This "section" can be a length of a well pipe, (to check the integrity of pipe joints etc. Alternatively, if the well pipe is perforated, this "section" can be a zone of the well (i.e. the formation surrounding the well pipe is also pressure tested). It should be noted that the section of a well may also be located above the upper sealing device 30.

A method for pressure testing of a section of a well W will be described below with reference to FIGS. 7 and 8. The well pipe is indicated with letters WP.

Initially, the setting tool 10 and the plugging tool 20 is assembled into the assembly 1 and lowered into the desired location in the well. The plugging tool 20 is in the retracted state during the lowering operation.

At the desired location, the setting tool 10 is actuated (by means of a topside signal, a pre-determined condition (desired depth, pressure, temperature etc.) to bring the plugging tool 20 to its radially expanded state. This is performed by moving the mandrel device 21 upwardly in relation to the outer housing 26 (or moving the outer housing 26 downwardly in relation to the mandrel device 21). Accordingly, the upper sealing device 30, the slips device 40, the lower sealing device 50 and the centralizing device 60 will be moved from their radially retracted state shown in FIG. 7 to their radially expanded state shown in FIG. 8.

When set, the pressure testing can be performed. This is typically performed by increasing the pressure above the plugging tool 20, thereby causing a higher pressure above the plugging tool 20 than below the plugging tool 20 and then monitor the pressure to check if the pressure is maintained at the desired level. If the pressure is not maintained at the desired level, for example the pressure is decreasing, this will normally represent an indication of a leakage. It is also possible to perform a test where pressure above the plugging tool 20 is decreased, thereby causing a higher pressure below the plugging tool 20 than above the plugging tool 20. Again, the pressure is monitored for a period of time.

The measurement of the pressure is measured by a topside sensor, or a sensor provided below the lower sealing device 50.

After the pressure testing, the upper sealing device 30, the slips device 40, the lower sealing device 50 and the centralizing device 60 is brought from their radially expanded state to their radially retracted state again by means of the setting tool 10.

Then, the well tool assembly 1 is moved to a new desired location in the well, and the procedure is repeated (expansion, testing, retraction, moving . . . ).

The setting tool 10 and the plugging tool 20 are connected to each other during these tests without any need to retrieve them to surface and without any risk of damaging the setting tool, as pressure differences over the plugging tool 20 are transferred from the upper and/or lower sealing devices 30, 50 to the slips device 40.

Hence, the testing procedure is more efficient than prior art.

Alternative Embodiments

As the setting tool 10 and the plugging tool 20 described above are connected to each other during the pressure testing operation, the well tool assembly could be assembled as one unit.

Figure 9:
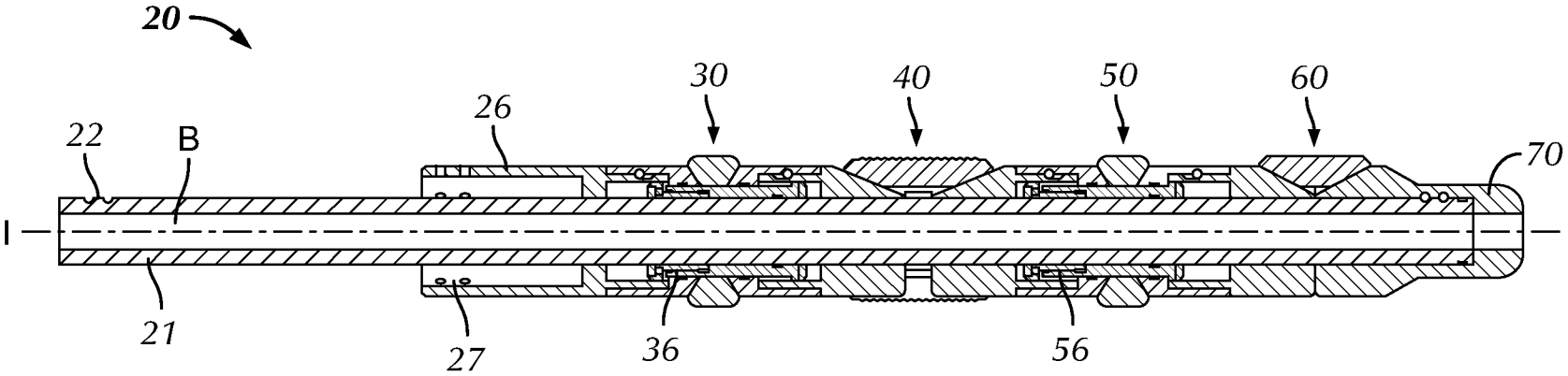
FIG. 9 illustrates an alternative embodiment where the inner mandrel device comprises a through bore.
Figure 10:
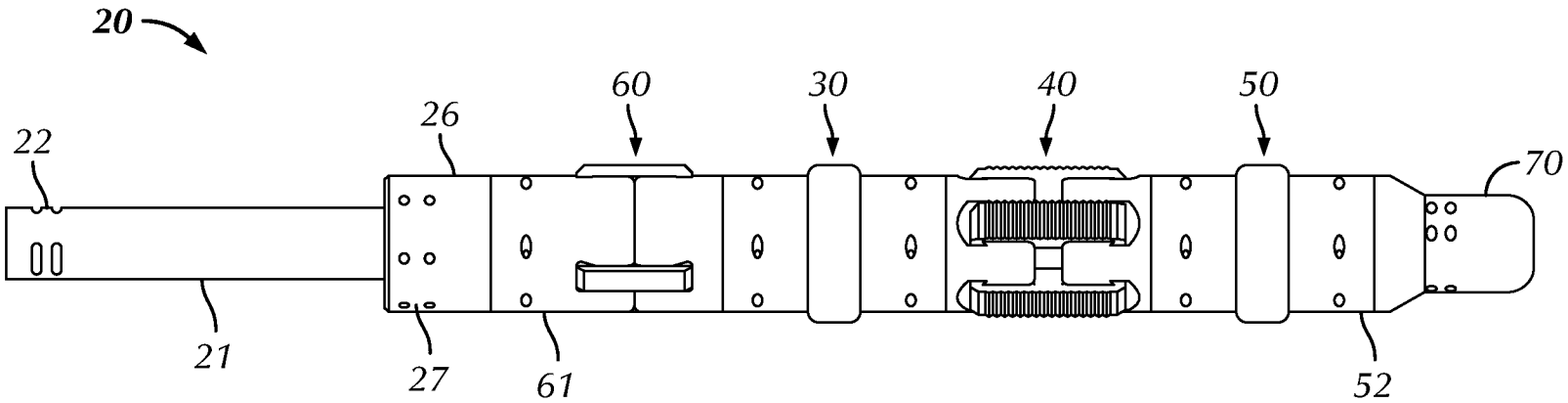
FIG. 10 illustrates an alternative embodiment where the centralizing device is provided above the upper sealing device.

It is now referred to FIG. 9, illustrating an alternative embodiment of the plugging tool 20 described above. Here, the bore B of the inner mandrel device 21 is a through bore. This embodiment can be used for well stimulation operations, fracking operations, washing operations (washing of perforations in well pipe, washing of screen etc).

The invention claimed is:

1. A well tool assembly comprising:

a setting tool and a plugging tool, wherein the setting tool comprises:

an inner actuator having an inner connection interface in a lower end;

an outer actuator having an outer connection interface in a lower end, wherein the setting tool is configured to provide relative axial motion between the inner and outer actuators, thereby causing the plugging tool to be moved between a radially retracted state and a radially expanded state;

wherein the plugging tool comprises:

an inner mandrel device having an inner connection interface connected to the inner connection interface of the setting tool;

an outer housing device provided radially outside of the mandrel device having an outer connection interface connected to the outer connection interface of the setting tool;

an upper sealing device comprising an upper sealing element provided axially between an upper section and a lower section;

a slips device comprising a slips element provided axially between an upper section and a lower section;

a lower sealing device comprising a sealing element provided axially between an upper section and a lower section;

a centralizing device comprising a centralizer element provided axially between an upper section and a lower section;

wherein the upper sealing device, the slips device, the lower sealing device, and the centralizing device are provided radially outside of the mandrel device;

wherein the upper sealing device, the slips device, the lower sealing device, and the centralizing device are connected to each other;

wherein the slips device is provided axially between the upper and lower sealing devices;

wherein the centralizing device is provided below the lower sealing device or above the upper sealing device;

wherein, when the centralizing device is provided below the lower sealing device:

the upper sealing device, the slips device, the lower sealing device, and the upper section of the centralizing device are axially displaceable downwardly and upwardly in relation to the mandrel device;

the upper section of the upper sealing device is connected to the outer housing device and the lower section of the centralizing device is fixed to the inner mandrel device;

or wherein, when the centralizing device is provided above the upper sealing device:

the centralizing device, the upper sealing device, the slips device, and the upper section of the lower sealing device are axially displaceable downwardly and upwardly in relation to the mandrel device;

the upper section of the centralizing device is connected to the outer housing device and the lower section of the lower sealing device is fixed to the inner mandrel device.

2. The well tool assembly according to claim 1, wherein the assembly is a pressure testing well tool assembly for pressure testing of a section of a well.

3. The well tool assembly according to claim 1, wherein the plugging tool is a ratchet-less plugging tool.

4. The well tool assembly according to claim 1, wherein the lower section of the lowermost device is comprising a nose section of the plugging tool, where the lose section is closing a bore of the inner mandrel device.

5. The well tool assembly according to claim 1, wherein the upper sealing device and the lower sealing device each comprises a pressure or force distribution device.

6. The well tool assembly according to claim 1, wherein, when the plugging tool is in the radially expanded state in a well pipe, and the well pressure is higher below the lower sealing device than above the upper sealing device, the fluid pressure acting on the lower sealing device will cause the slips device to radially expand the slips element radially out towards the well pipe.

7. The well tool assembly according to claim 1, wherein, when the plugging tool is in the radially expanded state in a well pipe, and the well pressure is higher above the upper sealing device than below the lower sealing device, the fluid pressure acting on the upper sealing device will cause the slips device to radially expand the slips element radially out towards the well pipe.

8. The well tool assembly according to claim 1, wherein the outer housing and the upper sealing device, the slips device, the lower sealing device, and the centralizing device are connected to each other by means of bolts inserted into tangential bolt openings of the respective upper and lower sections.

* * * * *